US007224771B2

(12) United States Patent
Levene et al.

(10) Patent No.: US 7,224,771 B2
(45) Date of Patent: May 29, 2007

(54) SHAPED ANODE X-RAY TUBE

(75) Inventors: Simha Levene, Hanegev (IL); Gabriel Malamud, Benyamina (IL); Altman Ami, Haifa (IL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/566,349

(22) PCT Filed: Jul. 16, 2004

(86) PCT No.: PCT/IB2004/002424

§ 371 (c)(1),
(2), (4) Date: Jan. 27, 2006

(87) PCT Pub. No.: WO2005/010916

PCT Pub. Date: Feb. 3, 2005

(65) Prior Publication Data

US 2006/0239409 A1 Oct. 26, 2006

Related U.S. Application Data

(60) Provisional application No. 60/491,032, filed on Jul. 30, 2003.

(51) Int. Cl.
*H01J 35/10* (2006.01)

(52) U.S. Cl. ..... 378/144; 378/136

(58) Field of Classification Search ..... 378/4, 378/19, 16, 63, 121, 123, 125, 134, 144, 378/145

See application file for complete search history.

(56) References Cited

U.S. PATENT DOCUMENTS

| | | | | |
|---|---|---|---|---|
| 2,942,126 | A * | 6/1960 | Silbermann | 378/109 |
| 3,610,984 | A * | 10/1971 | Seki et al. | 378/125 |
| 4,107,563 | A * | 8/1978 | Oddell | 378/126 |
| 4,287,420 | A * | 9/1981 | Yamamura et al. | 378/41 |
| 4,355,409 | A * | 10/1982 | Amplatz | 378/146 |
| 6,163,593 | A | 12/2000 | Koller et al. | 378/144 |
| 6,198,805 | B1 | 3/2001 | Jambunathan et al. | 378/144 |
| 6,236,713 | B1 | 5/2001 | True et al. | 378/138 |
| 2002/0106056 | A1 | 8/2002 | Mattson | 378/144 |
| 2003/0128801 | A1 * | 7/2003 | Eisenberg et al. | 378/19 |

FOREIGN PATENT DOCUMENTS

| | | |
|---|---|---|
| CH | 673176 A5 | 2/1990 |
| DE | 30 16 102 A1 | 10/1981 |
| DE | 19900468 A1 | 1/1999 |

* cited by examiner

*Primary Examiner*—Edward J. Glick
*Assistant Examiner*—Irakli Kiknadze

(57) ABSTRACT

An x-ray tube (16) suitable for use in a computed tomography (CT) scanner (10) includes an envelope (42) which defines an evacuated chamber. An anode (40) and a cathode assembly (70) are disposed within the chamber. The anode defines a target area (56) which is struck by electrons (52) emitted by a filament (54) of the cathode assembly and emits x-rays (46). The target area lies partially on a first annular portion (80) which is disposed at first angle (a) relative to a plane perpendicular to an axis of rotation (R) of the anode, and partially on a second portion (82,120) which is radially spaced from the first portion and disposed at a second angle (β), relative to the plane. The second angle is greater than the first angle. The portions of different slope allow the x-ray tube to take advantage of a shallow angle, while minimizing the heel effect.

20 Claims, 6 Drawing Sheets

SHAPED ANODE X-RAY TUBE

CROSS REFERENCE TO RELATED APPLICATIONS

This application claims the benefit of U.S. provisional application Ser. No. 60/491,032 filed Jul. 30, 2003, which is incorporated herein by reference.

The present application relates to the x-ray tube arts. The invention finds particular application in x-ray tube assemblies for large bore computed tomography scanners. It is to be appreciated, that the present invention finds further application in other higher power x-ray devices where it is desirable to increase the anode current without incurring a heat loading which is damaging to the anode.

Computed tomography (CT) scanners radiographically examine a subject disposed on a patient support and generate diagnostic images of the subject. An x-ray tube assembly is mounted on a rotating gantry and projects a beam of radiation through a section of the subject which is detected by a detection system, such as an array of two-dimensional detectors which are mounted on the rotating gantry or a ring of detectors on the stationary gantry. To increase the width of the slice or cone beam which is irradiated, the width of the detector array, parallel to the axis of rotation of the anode, has been progressively increased. This increased width, in combination with faster scan times, places higher demands on the x-ray tube, in terms of generating a higher x-ray flux.

X-rays from conventional rotating anode x-ray tubes are typically emitted from a target on the sloped, peripheral edge of the anode typically at a point nearest the patient, where the electrons strike and are converted to x-rays. The x-ray beam is typically collimated into a fan or wedge of x-rays at an angle which is about 90° to the beam of electrons striking the anode. The peripheral edge is generally provided with a slope to increase the target area at which a focused election beam strikes the anode, thereby decreasing the current loading per unit area of the target. The width of the x-ray beam source (the focal spot width) is a projection of the height (radially) of the target area. More specifically, the projection is a function of the electron beam height times the tangent of the angle of the slope of the peripheral face of the anode.

As a result of the demand for higher loadings, in recent years, the slope has decreased from about 10° (relative to an axis perpendicular to the beam of electrons) to about 7°, or less. As seen from the table below, this enables an increase of over 40% in anode current for the same heat loading at a given projected focal spot size as viewed in the x-ray beam direction.

| Anode slope (degrees) | Slope length (mm) for a 1 mm projection | Relative loading |
|---|---|---|
| 6 | 9.51 | 168 |
| 7 | 8.14 | 144 |
| 8 | 7.12 | 125 |
| 9 | 6.31 | 111 |
| 10 | 5.67 | 100 |
| 11 | 5.14 | 91 |
| 12 | 4.70 | 83 |

At shallow angles (e.g., 7°), however, there is a tendency for the x-ray beam to be truncated or reduced in x-ray flux at the heel. Specifically, not all the incident electrons generate x-rays at the surface of the anode face. Rather, some electrons penetrate deeply within the target before generating x-rays. X-rays generated at the surface do not pass through the anode, provided the beam angle is not wider than twice the target slope. However, x-rays generated within the target must pass through it and are attenuated by the heavy metal of the target. The flatter the slope of the peripheral face and the wider the beam angle, the further the interior-generated x-rays must travel through the anode metal before emerging in the direction of the output beam. The heel effect attenuation is greater for x-rays on the anode side of the beam.

The CT scanner manufacturer is thus faced with the choice of specifying either an anode of shallow slope (e.g., 7°), which is limited in terms of the beam angle it can provide because of the heel effect, or of steeper slope (e.g., 10°), which is limited in terms of the loading it can sustain.

The present invention provides a new and improved method and apparatus which overcome the above-referenced problems and others.

In accordance with one aspect of the present invention, an x-ray tube is provided. The x-ray tube includes an envelope which defines an evacuated chamber and a source of electrons. An anode is mounted in the chamber for rotation about an axis of rotation. The anode defines a sloped peripheral region on which a target area is defined, which target area is struck by electrons emitted by the electron source and emits x-rays. The sloped peripheral region includes a first annular portion sloped at a first angle relative to a plane perpendicular to the axis of rotation and a second annular portion, adjacent the first, sloped at a second angle relative to the plane. The second angle is different from the first angle. The target area is defined partially on the first annular portion and partially on the second annular portion.

In accordance with another aspect of the present invention, a method of generating a beam of x-rays is provided. A beam of electrons is accelerated and focused to strike a target area on a sloping peripheral region of an anode which rotates about an axis of rotation. The anode peripheral region includes a first annular portion sloped at a first angle relative to a plane perpendicular to the axis of rotation and a second annular portion radially spaced from the first and sloped at a second angle. The second angle is different from the first. The target area is defined partially on the first annular portion and partially on the second.

One advantage is that it enables an anode to have a shallow slope while maintaining a sufficiently large beam angle.

Another advantage of at least one embodiment of the present invention is that it facilitates generating higher flux, wider x-ray beams.

Another advantage resides in reduced anode heating.

Still further advantages of the present invention will become apparent to those of ordinary skill in the art upon reading and understanding the following detailed description of the preferred embodiments.

The invention may take form in various components and arrangements of components, and in various steps and arrangements of steps. The drawings are only for purposes of illustrating a preferred embodiment and are not to be construed as limiting the invention.

Figure 1:
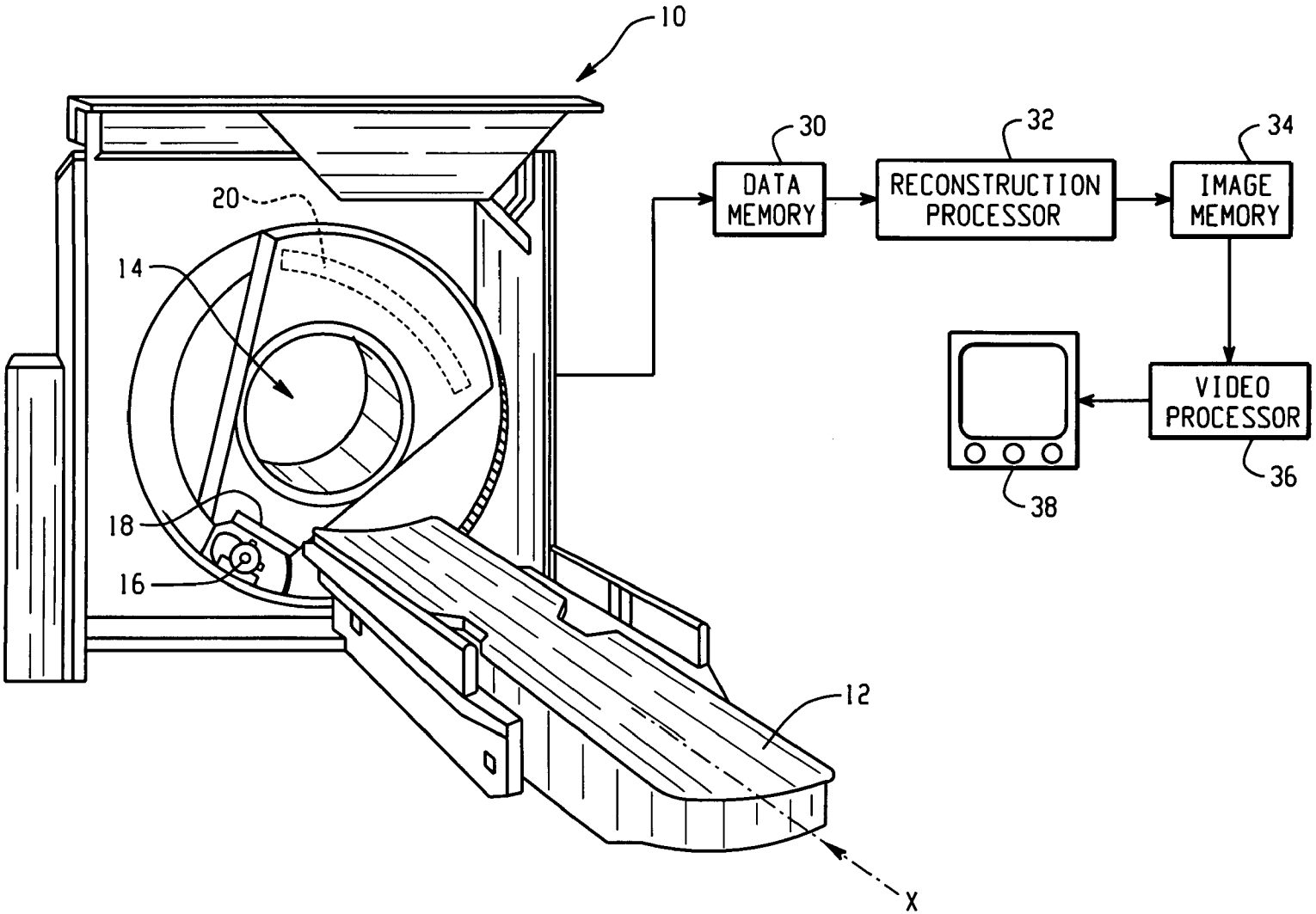
FIG. 1 is a diagrammatic illustration of a computed tomography scanner incorporating the present invention.

With reference to FIG. 1, a computed tomography (CT) scanner 10 radiographically examines and generates diagnostic images of a subject disposed on a patient support 12. More specifically, a volume of interest of the subject on the support 12 is moved into an examination region 14, typically by translating the support 12 in a direction Z. An x-ray tube assembly 16 mounted on a rotating gantry projects one or more beams of radiation through the examination region 14. A collimator 18 collimates the beams of radiation in two dimensions. In the preferred embodiment, a two-dimensional x-ray detector 20 is disposed on the rotating gantry across the examination region 14 from the x-ray tube. In another embodiment, a ring or array of two-dimensional detectors is mounted on a stationary gantry around the rotating gantry.

The x-ray detector 20 operates in known ways to convert x-rays that have traversed the examination region 14 into electrical signals indicative of x-ray absorption between the x-ray tube 16 and the detector 20. The electrical signals, along with information on the angular position of the rotating gantry, are communicated to a data memory 30. The data from the data memory 30 is reconstructed by a reconstruction processor 32. Various known reconstruction techniques are contemplated including cone beam, multi-slice, and spiral scanning and reconstruction techniques, and the like. The volumetric image representation generated by the reconstruction processor 32 is stored in a volumetric image memory 34. A video processor 36 withdraws selective portions of the image memory to create slice images, projection images, surface renderings, and the like and reformats them for display on a monitor 38, such as a CRT or LCD monitor.

Figure 2:
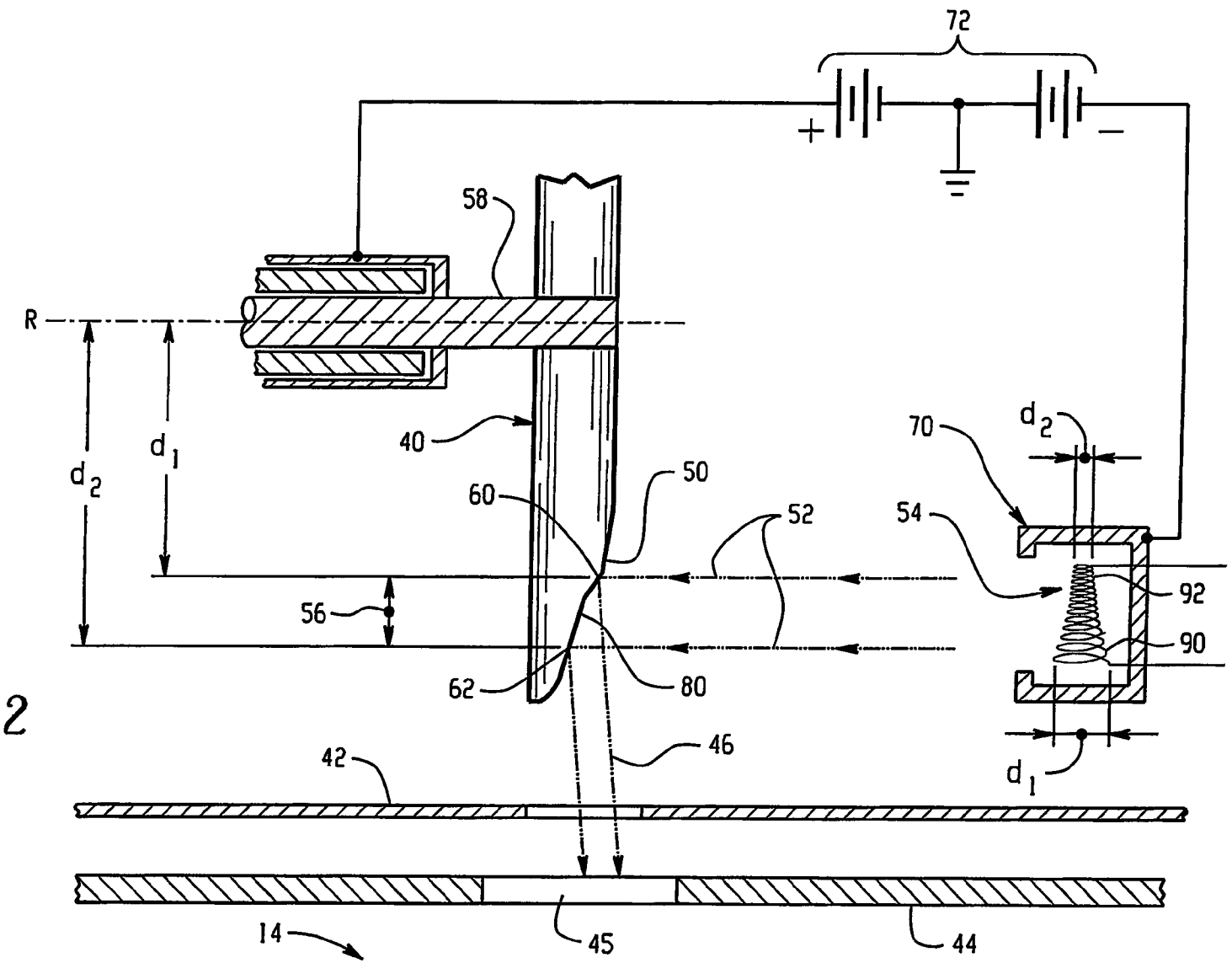
FIG. 2 is a partial cross-sectional view of one embodiment of an x-ray tube of the computed tomography scanner of FIG. 1.

With reference now to FIG. 2, the x-ray tube assembly 16 includes a disk-shaped anode 40, which is mounted within an air-evacuated envelope 42 and may be in a plane perpendicular to the axis of rotation of the rotating gantry, although other geometries are also contemplated. The evacuated envelope is surrounded with a lead or another high-Z metal with good x-ray stopping power housing 44 which defines a cooling reservoir. A window 45 of beryllium or other low-Z metal or material defines an exit near the examination region 14 through which x-rays 46 enter the examination region 14. Situated between the examination region 14 and the window 45 is a beam-shaping filter (not shown) and the collimator 18.

The anode 40 has a sloped, annular peripheral edge 50 which is struck by a beam 52 of electrons generated by a source of electrons, such as a filament 54 of a cathode assembly. The beam of electrons is focused to strike a limited, defined area or target 56 on the sloped edge. The anode is mounted on a central shaft 58 and rotates about an axis R, which is generally parallel with the beam of electrons 52 and perpendicular to a front face of the anode. The sloped target 56 is spaced from the axis R by a distance $d_1$ at its inner peripheral edge 60 and by a distance $d_2$ at its outer peripheral edge 62. The majority of the electrons in the beam 52 strike the anode in the target 56, with only a minimal proportion striking other parts of the anode surface. The target 56 preferably receives at least 90% of the electrons which are emitted by the cathode and which hit the anode, more preferably, at least about 99% of these electrons.

The filament 54 is mounted in a cathode cup 70, which acts as a focusing device to focus the electrons emitted by the filament into the beam 52 which is accelerated by a high voltage source 72 to the anode. The cathode cup and filament, which together make up a cathode assembly, remain stationary, with respect to the envelope 42, although it is also contemplated that the cathode assembly may rotate while the anode remains stationary. In any event, the cathode assembly remains stationary with respect to the output beam 46.

Figure 3:
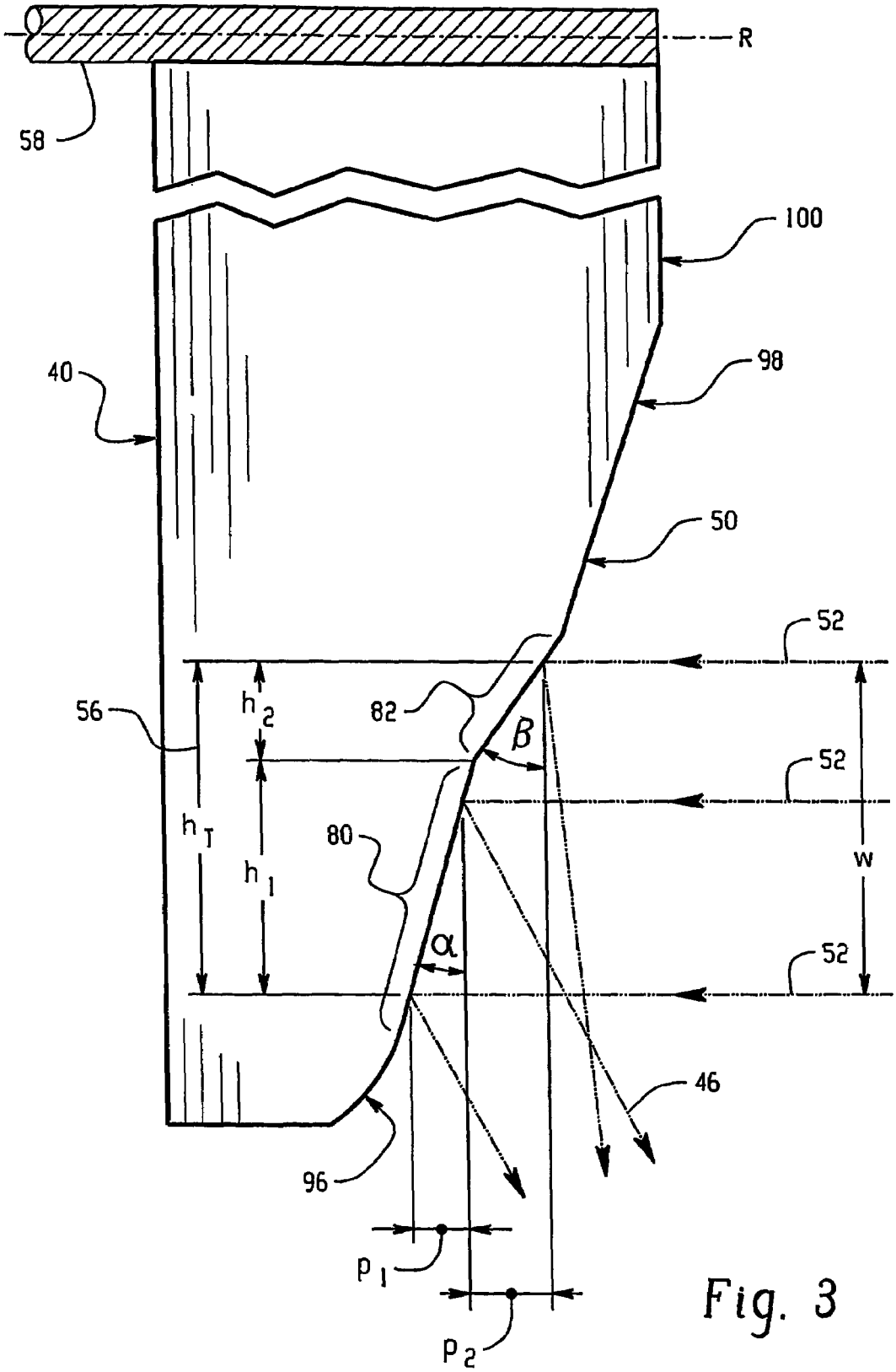
FIG. 3 is a detailed cross-sectional view of the anode of an x-ray tube of FIG. 2.

With continued reference to FIG. 2, and reference also to FIG. 3, the target 56 is defined partially on a primary portion 80 of the peripheral edge 50 and partially on a secondary portion 82 of the peripheral edge. The secondary portion 82 is located radially inward of the primary portion 80. The primary portion 80 extends at an angle $\alpha$ to a plane which is perpendicular to the axis R of the anode. The secondary portion extends at an angle $\beta$ to an axis which is perpendicular to the axis R of the anode. Angle $\beta$ is larger than angle $\alpha$. In one embodiment, the angles $\alpha$ and $\beta$ differ by at least 1°. In another embodiment, the angles differ by at least 2°. For example, angle $\alpha$ is from about 6° to about 8°, while angle $\beta$ is from about 8° to about 12°. In one specific preferred embodiment, the angle $\alpha$ is about 7° and the angle $\beta$ is at least about 9°, preferably 10°. The lower limit of the angle $\alpha$ depends on the detectors, the resolution, and the width of the beam desired. In currently available CT systems, these do not allow an angle $\alpha$ of much less than 6°, although it is contemplated that advances in CT scanner technology may permit smaller angles.

In the preferred embodiment, the majority of the electrons which strike the target 56 strike in the primary portion 80. In one specific embodiment, at least about 60% of the electrons which strike the target, strike the primary portion 80, with the balance of 40%, or less striking the secondary portion 82. Preferably, at least 80% of the electrons striking the target 56 strike one or other of the primary and secondary portions, more preferably, at least 90%. In FIG. 3, the primary portion 80 is shown as ending abruptly as the interface with the secondary portion 82, although it preferably does not do so, as discussed below.

The combination of the primary portion 80 with the secondary portion 82 allows for a high power, due to the shallow angle of the primary portion, while reducing the heel effect with the secondary portion. The projection $p_1$ of the x-ray beam from the primary portion 80 is related to the height $h_1$ of the electron beam striking the primary portion by the expression:

$$P_1=h_1 \tan\alpha$$

and similarly for the secondary portion 82:

$$p_2=h_2 \tan\beta$$

where $P_2$ and $h_2$ are the projection and height, respectively, of the secondary portion. It will be appreciated that $h_1$ and $h_2$ may be less than or equal to the actual heights of the primary and secondary portions, where the electron beam width w does not extend beyond these portions. For this embodiment, where the first and second portions are directly adjacent, $h_1+h_2=h_T=w$.

With reference once more to FIG. 2, the filament 54 includes a first portion 90 and a second portion 92. Due to the focusing effects of the cathode cup 70, the x-rays emitted by the first portion 90 predominantly strike the primary portion 80 of the target; while the x-rays emitted by the second portion 92 predominantly strike the secondary portion 82 of the target. The first portion 90 of the filament emits a higher current than the second portion 92. It will be appreciated that although the first filament portion 90 is shown as being axially aligned with the primary target portion 80, and the secondary filament portion 92 aligned with secondary target portion 82, in cathodes which include inversion-type electronics, where the upper half of the filament is imaged on the lower half of the target, the relative positions of portions 90 and 92 are reversed.

The larger current of the first portion 90 is readily achieved by providing a larger coil diameter $d_1$ for the first portion 90 than the coil diameter $d_2$ of the second portion 92. Other known methods of providing a larger current are also contemplated. The x-ray flux emitted (photons per unit area) is thus lower for the secondary target portion 82 than for the primary target portion 80. To accommodate for any variations in the flux, the reconstruction processor 32 of the CT scanner (FIG. 1) is optionally programmed to take the variations in flux into account when reconstructing the image.

Preferably, the electron source is configured to deliver the same (or at least substantially the same) specific load to the anode in all portions of the target. Preferably, the specific load on the first annular portion is within ±10% of the specific load on the second annular portion. Specific load can be defined as the current (in mA) per unit area ($cm^2$) of the sloped surface.

The shaping of the filament exploits the shaping of the anode by distribution the current load over its surface appropriately. When the filament current is increased, the cathode emission will increase proportionately at all points, and the image of the filament upon the anode will become uniformly brighter, with substantially unchanged ratio of the currents in its first and second portions 90 and 92.

In an alternative embodiment, the source of electrons 54 comprises two filaments of helically wrapped wire or conductive film, a first filament, similar in dimensions to the first filament portion 90, emitting a first stream of electrons which are accelerated to strike the primary target portion 80, the second filament, similar in dimensions to the second filament portion 92, emitting a second stream of electrons which are accelerated to strike the secondary target portion 82. The optimal relative heights of the target portions 80, 82 depends, in part on the CT scanner in which the x-ray tube is employed and in part on the desired coverage. For example, a multislice CT scanner using 100 slices will generally benefit from a larger $h_1/h_2$ ratio than a 50 slice scanner of given width.

As shown in FIG. 3, portions 96, 98 of the anode surface adjacent the target area 56 are also sloped, relative to the beam direction. The slope of these portions may be the same as that of the adjacent portion 80 or 82 of the target, or the slope may be different.

Figure 4:
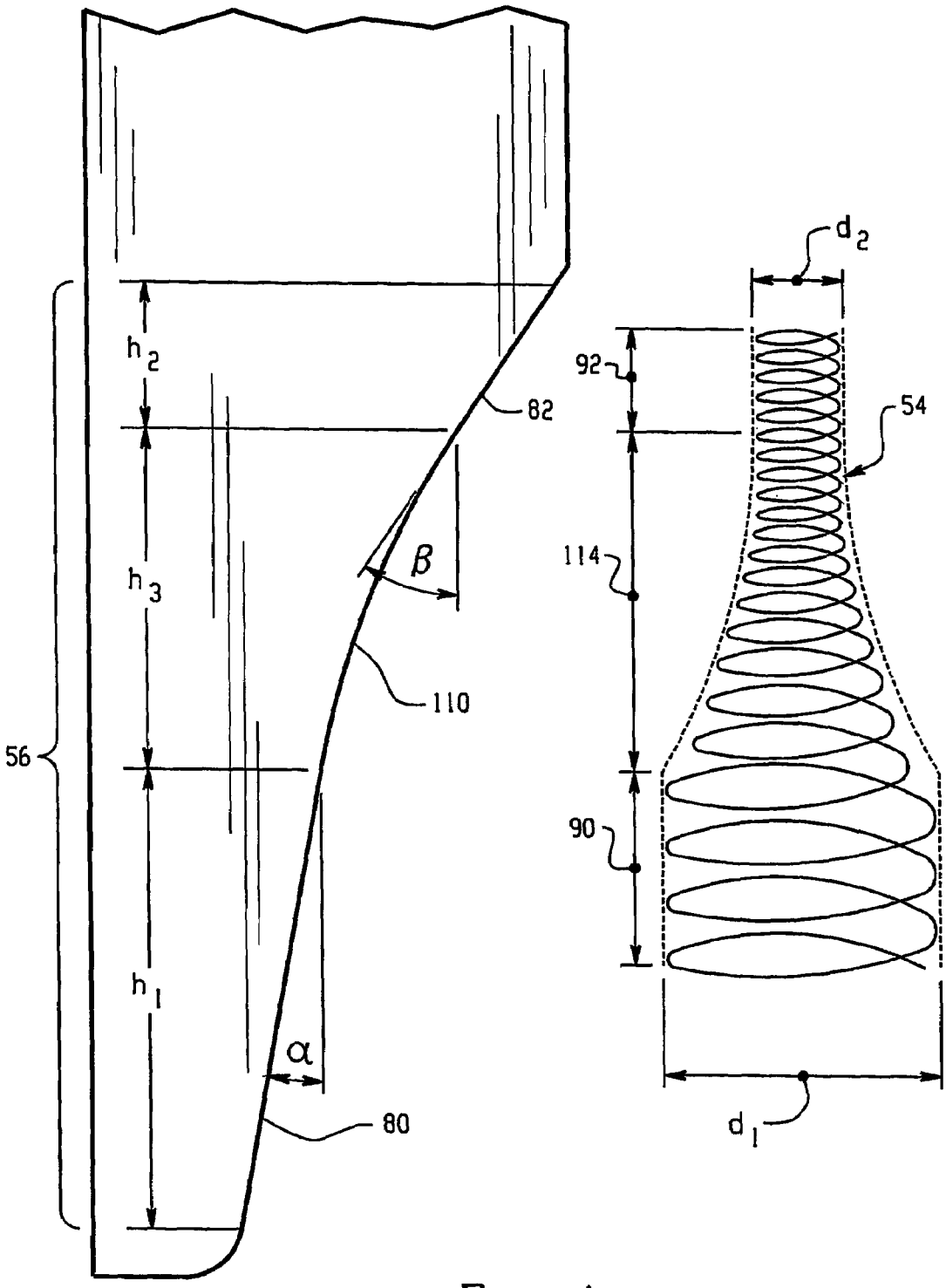
FIG. 4 is a diagrammatic cross-sectional view of an anode and filament combination of another embodiment.
Figure 5:
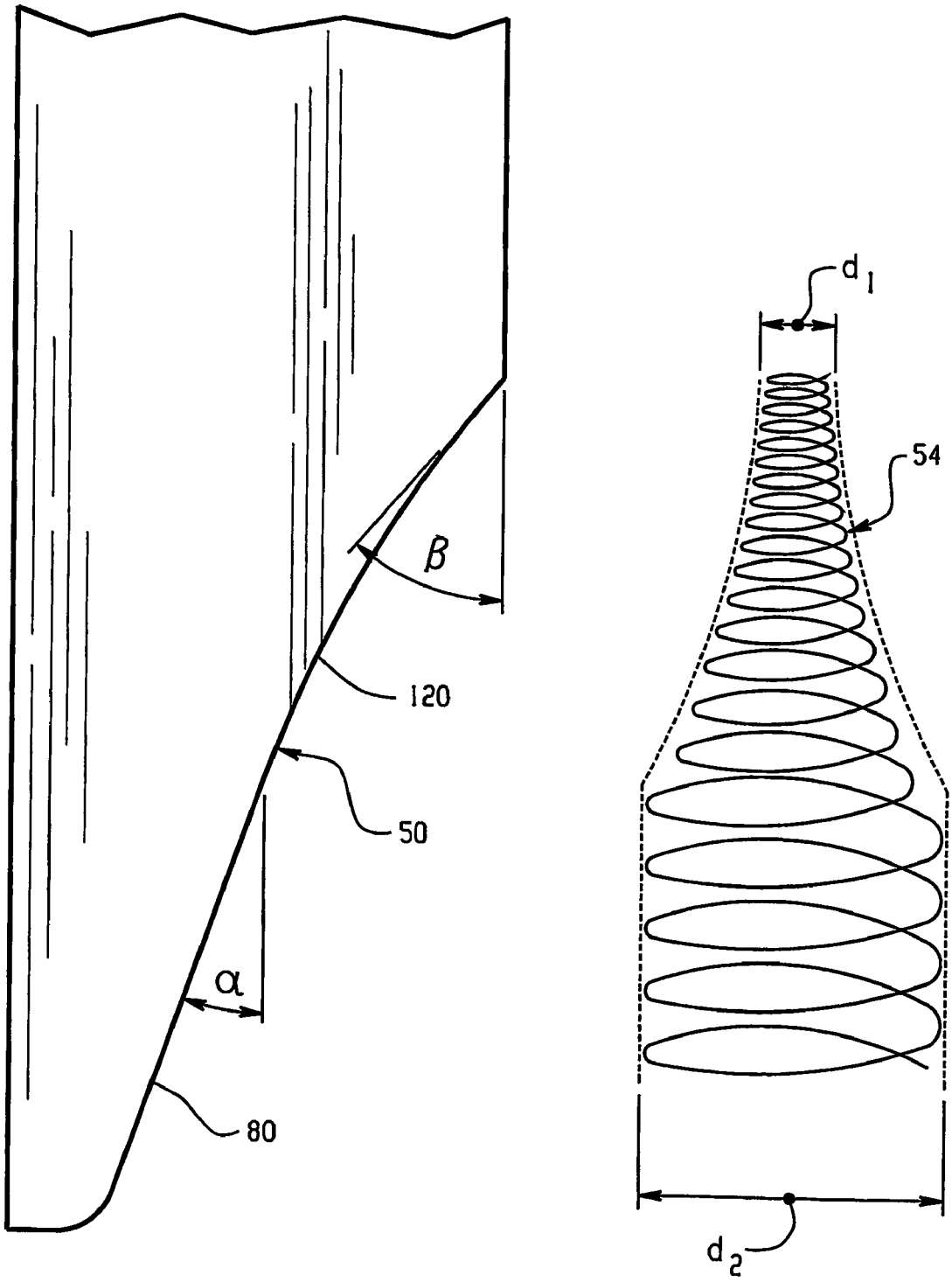
FIG. 5 is another diagrammatic view of a cross-section of anode and filament combination.
Figure 6:
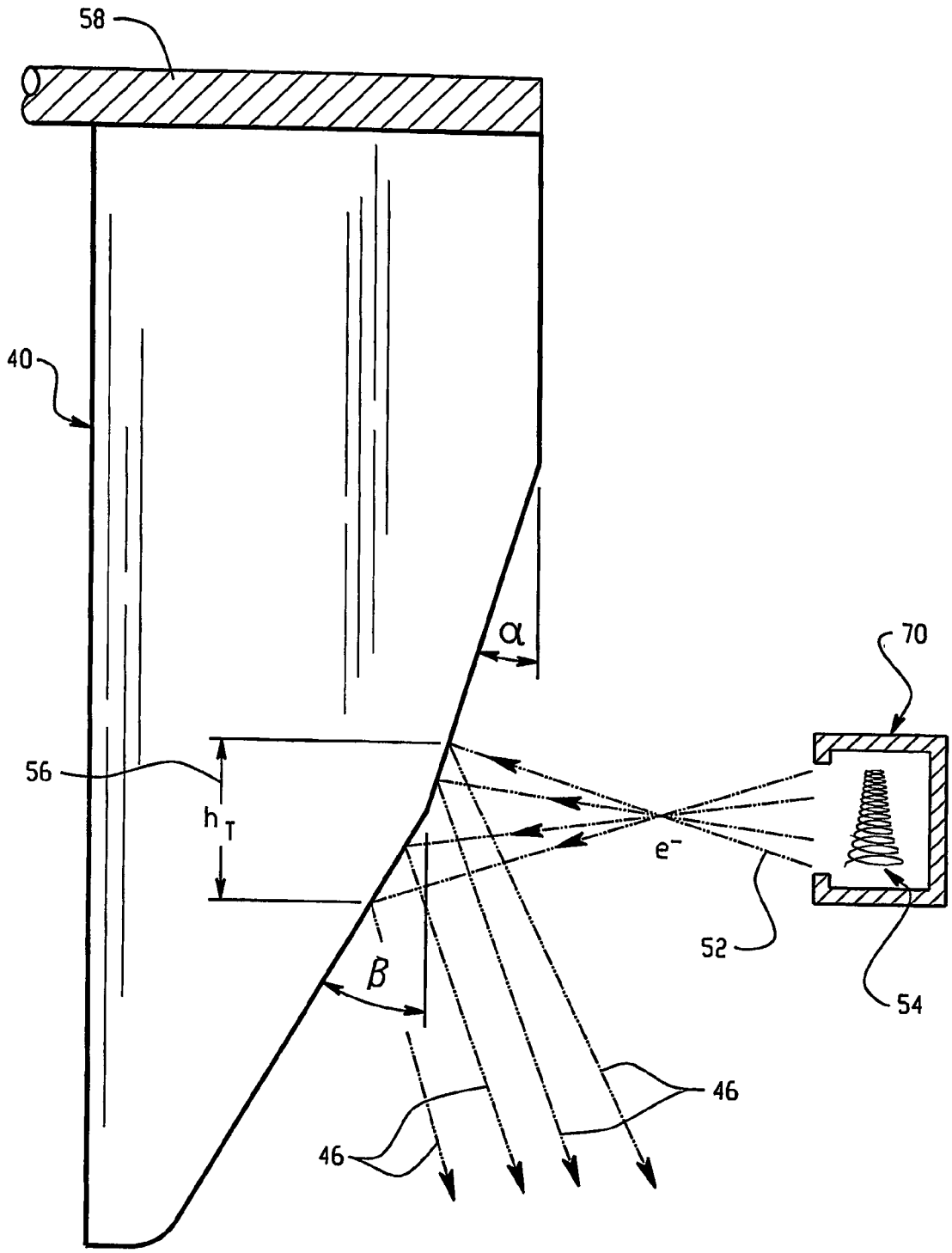
FIG. 6 is yet another diagrammatic, partial cross-sectional view of an anode and cathode filament combination.

The configuration of FIGS. 2 and 3 helps to alleviate the heel effect by providing a region 82 of greater slope at the periphery of the primary portion 80. Other embodiments which also provide for regions of different slope are shown in FIGS. 4-6, where similar elements are given the same numerals and different elements are given new numerals. The x-ray tubes and anode configurations for these embodiments are the same as for that of FIGS. 2 and 3, except as otherwise noted. It will be appreciated that in all the FIGURES, the angles α and β have been shown larger than they are in practice for clarity and ease of illustration.

In the embodiment shown in FIG. 4, the primary target portion 80 is connected with the secondary portion 82 by a smooth or curved transition portion 110, which is tangential to the angle α adjacent the primary portion 80 and is tangential to the angle β adjacent the secondary portion 82. The curved portion 110 thus provides a gradual increase in the angle of the target slope from α, adjacent the primary portion 80, to β, adjacent the secondary portion 82. The angles α and β can have the same values as described for the embodiment of FIGS. 2 and 3 (e.g., 7° and 10°, respectively). In one embodiment, the curved portion 110 is about 1-2 mm in height $h_3$, i.e., only a small proportion of the target height $h_T$. For this embodiment, where the first and second portions are spaced by the transition portion 110, $h_1+h_2+h_3=h_T=w$.

It will be appreciated that although the transition portion 110 is shown as being of similar length in primary and secondary to portions 80 and 82, in practice, where the angles α and β are closer to the 7° and 10° discussed above, the curved portion preferably has a height $h_3$ which is shorter than height $h_1$ of the primary portion 80 and is optionally shorter than the height $h_2$ of the secondary portion 82.

The coil 54 preferably transitions smoothly to match the transition portion 110 of the target 56. As shown in FIG. 4, the filament coil 54 has a width (diameter) d which is inversely proportional to tan θ ($d=K/\tan\theta$), where θ is the angle of the target at the point at which the electrons strike and K is a constant. Thus, for the first portion 90 of the coil, which corresponds to the primary target portion 80, the width $d_1=K/\tan\alpha$ and for the secondary portion 92, the width $d_2=K/\tan\beta$, as for the first embodiment. For a transition region 114 of the coil between the first and second portions 90, 92, the width gradually changes, as a function of the tangent, tan θ. As for the first embodiment, the reconstruction processor 32 is programmed to accommodate for the change in flux which occurs as a result of the changing width of the filament coil 54.

An advantage of this embodiment is that the placement of the image of the filament on the anode need not be as precise as for the embodiment of FIGS. 2 and 3, to avoid variations in x-ray output. As x-ray tube bearings wear, the anode tends to suffer increasingly from anode wobble. Having the gradually curving transition portion 110 rather than a sharp change between the primary and secondary portions 80 and 82 reduces the effects of the anode wobble upon x-ray output, prolonging the useful life of the x-ray tube.

With reference now to FIG. 5, another embodiment of an anode is shown. In this embodiment, the target 56 includes a first portion 80 having the slope α, as discussed above (e.g., 7°). A second portion 120 is curved with the curvature increasing, away from the first portion 80. In one embodiment, the second portion transitions from the angle α at the intersection with the first portion and increases to the angle β at its outer edge. β can be greater than 10°, for example, 12° or as high as about 15°. The optimal value of β depends, to some extent, on the number of slices used by the CT scanner. For larger numbers of slices a larger angle β is generally preferred. For example, for 50 slices, a β of 12° may be optimal, whereas for 100 slices, closer to 15° may be optimal for β.

As with the other embodiments, the filament 54 is preferably shaped to match the change in slope of the target, with the width being generally described by $d=K/\tan\theta$.

As with the embodiment of FIG. 5, this embodiment is less sensitive to anode wobble than that of FIGS. 3 and 4.

FIG. 6 illustrates an embodiment in which the flatter and more sloped regions are reversed in position. The target 56 slopes at an angle α near the inside or top of the anode and progresses smoothly to an angle β at the other end of the target area. In the illustrated embodiment, the cathode cup 70 is configured such that the filament 54 focuses a mirror image on the target. The filament 54 again produces electrons in inverse proportion to the slope of the receiving face. Because the embodiment of FIG. 6 is becoming progressively steeper, the path length through the anode traveled by x-rays which are generated below the surface of the anode becomes progressively shorter reducing attenuation and heeling effect. Although shown as a continuous smooth curve, it is to be appreciated that the target area can be two linear segments, two linear segments connected by a smooth transition region, a single linear segment and a continuously curved transition region and secondary region, or the like. As another option, a dual filament can be provided such that the target area can be expanded from the illustrated region 56 where the slope is between angles $\alpha$ and $\beta$, e.g. between 7 and 12°, and extended to a region where the slope is larger, e.g., 15°.

The invention has been described with reference to the preferred embodiment. Modifications and alterations will occur to others upon a reading and understanding of the preceding detailed description. It is intended that the invention be construed as including all such modifications and alterations insofar as they come within the scope of the appended claims or the equivalents thereof.

Having thus described the preferred embodiment, the invention is now claimed to be:

1. An x-ray tube comprising:

an envelope which defines an evacuated chamber;

a source of electrons;

an anode mounted within the chamber for rotation about an axis of rotation, the anode defining a sloped peripheral region on which a target area is defined, which target area is struck by electrons emitted by the electron source and emits x-rays, the sloped peripheral region including a first annular portion, sloped at first angle relative to a plane perpendicular to the axis of rotation, and a second annular portion, adjacent the first portion, sloped at a second angle, relative to the plane, the second angle being different from the first angle, the target area being defined partially on the first annular portion and partially on the second annular portion, wherein the source of electrons includes a filament having a greater width in a region of the filament which emits electrons that strike the portion of the target area on the first annular portion and a smaller width in a region which emits electrons which strike the portion of the target area on the second annular portion.

2. The x-ray tube of claim 1, wherein the first annular portion is closer to a periphery of the anode than the second portion.

3. The x-ray tube of claim 1, wherein the first angle and the second angle differ by at least 1°.

4. The x-ray tube of claim 3, wherein the first and second angles differ by at least 2°.

5. The x-ray tube of claim 1, wherein the first angle is less than about 8°.

6. The x-ray tube of claim 5, wherein the first angle is about 7°.

7. The x-ray tube of claim 1, wherein the first angle is from about 6° to about 8°.

8. The x-ray tube of claim 7, wherein the second angle is at least 8°.

9. The x-ray tube of claim 8, wherein the second angle is about 10°.

10. The x-ray tube of claim 1, further including:

an annular transition portion intermediate the first and second portions, the transition portion defining a smooth, curved transition between the first portion and the second portion.

11. The x-ray tube of claim 10, wherein the transition portion curves gradually from the first portion to the second portion, the transition portion sloped at the first angle adjacent the first portion and sloped at the second angle adjacent the second portion.

12. The x-ray tube of claim 1, wherein the second portion increases in slope with distance from the first portion.

13. The x-ray tube of claim 1, wherein the first angle is smaller than the second angle, and the electron source is configured to deliver substantially the same specific load to the portion of the target area on the first portion than to the portion of the target area on the second portion.

14. The x-ray tube of claim 1, wherein the width of the filament varies such that the width is inversely proportional to a tangent of an angle of a slope of a region of the target area that is struck by the electrons from the region of the filament.

15. A computed tomography (CT) scanner including the x-ray tube of claim 1.

16. The CT scanner of claim 15, wherein the CT scanner includes at least one x-ray detector and a reconstruction processor, the reconstruction processor being programmed to account for a higher x-ray flux from the first annular portion than from the second annular portion.

17. A method for generating a beam of x-rays, comprising:

accelerating and focusing a beam of electrons;

striking a target area on a sloping peripheral region of an anode that rotates about an axis of rotation, the peripheral region including a first annular portion sloped at first angle relative to a plane perpendicular to the axis of rotation, and a second annular portion, radially spaced from the first annular portion and sloped at a second angle relative to the plane, the second angle being different from the first angle, the target area being defined partially on the first annular portion and partially on the second annular portion; and generating electrons such that a portion of the electron beam which strikes the target area on the first annular portion has a greater electron current density than a portion of the electron beam which strikes the part of the target on the second annular portion.

18. The method of claim 17, wherein the angle at which the first annular portion is sloped is smaller than the angle at which the second annular portion is sloped.

19. The method of claim 17, further including:

directing the x-rays towards a subject;

detecting x-rays passing through the subject with a detector; and reconstructing an image of the subject, including accounting for a larger flux of x-rays from the part of the target area on the first annular portion than from the part of the target area on the second annular portion.

20. An x-ray tube, comprising:

an anode that rotates about an axis of rotation, the anode includes a sloped peripheral region upon which a target area is defined, wherein the sloped peripheral region includes:

a first annular portion that is sloped at a first angle relative to a plane perpendicular to the axis of rotation; and a second annular portion adjacent to the first annular portion, wherein the second annular portion is sloped at a second angle relative to the plane, the second angle being different from the first angle; and an electron source that emits electrons towards the target area such that a portion of the electron beam that strikes the target area on the first annular portion has a greater electron current density than a portion of the electron beam which strikes the target area on the second annular portion.

* * * * *